United States Patent [19]

Spruck

[11] Patent Number: 4,551,027

[45] Date of Patent: Nov. 5, 1985

[54] DEVICE FOR DETERMINING TIME OF SUNRISE AND SUNSET

[76] Inventor: George T. Spruck, 5819 Monfort Hills Ave., Cincinnati, Ohio 45239

[21] Appl. No.: 338,313

[22] Filed: Jan. 11, 1982

[51] Int. Cl.[4] ..... G04B 19/26

[52] U.S. Cl. ..... 368/15; 368/17

[58] Field of Search ..... 368/16, 17; 235/78 G, 235/78 R, 78 N, 78 RC, 85 R, 83, 88 N, 88 RC, 88 G, 88 R

[56] References Cited

U.S. PATENT DOCUMENTS

| | | | |
|---|---|---|---|
| 1,145,020 | 7/1915 | Hill | 235/78 N |
| 1,153,492 | 9/1915 | Hoitinga | 368/17 |
| 3,290,799 | 12/1966 | Eisenhauer | 235/88 |
| 3,971,915 | 7/1976 | Fletcher et al. | 235/78 M |
| 4,435,640 | 3/1984 | Micheletto | 255/88 M |

*Primary Examiner*—Bernard Roskoski

*Attorney, Agent, or Firm*—James W. Pearce; Roy F. Schaeperklaus

[57] ABSTRACT

A device for determining the time of solar passage of the horizon. The device includes a clock face having hour and minute indications arranged circumferentially thereof and a disc rotatably mounted in overlying relation with the clock face. Solar passage information on the disc is aligned by reference to a selected longitude so that a line from the center of the disc through a selected portion of the solar passage information intercepts hour and minute indications of the clock face at a time of solar passage for the selected portion of the solar passage information at the selected longitude.

8 Claims, 5 Drawing Figures

DEVICE FOR DETERMINING TIME OF SUNRISE AND SUNSET

This invention relates to a clock-like instrument for determining times of solar passage of the horizon such as sunrise and sunset.

An object of this invention is to provide an instrument having a clock face and apparatus which can be arranged with relation to the clock face to indicate time of sunrise and sunset.

A further object of this invention is to provide such a device which includes means for adjusting for month and day of the month, means for adjusting for latitude, and means for adjusting for longitude and daylight savings.

A further object of this invention is to provide such a device which includes a dial that can be swung to adjust for longitude and daylight savings.

A further object of this invention is to provide such a device which includes separate scales for selected latitudes which can be selectively positioned for indicating times of sunrise and sunset for the selected latitudes.

Briefly, this invention provides a device for determining times of solar passage of the horizon, such as sunrise and sunset, which includes a clock face having a transparent cover member overlying the clock face. An auxiliary disc is rotatably mounted on the cover member at the center of the clock face. The auxiliary disc carries aligning arc units arranged to indicate months of the year. An alignment indicator or tic mark on the auxiliary dial can be aligned with hour and minute markers on the clock face. A radius through a selected date on a sunrise arc unit indicates the time of sunrise. Another radius through a selected date on a sunset arc unit indicates the time of sunset.

The above and other objects and features of the invention will be apparent to those skilled in the art to which this invention pertains from the following detailed description and the drawings, in which.

In the following detailed description and the drawings, like reference characters indicate like parts.

Figure 1:
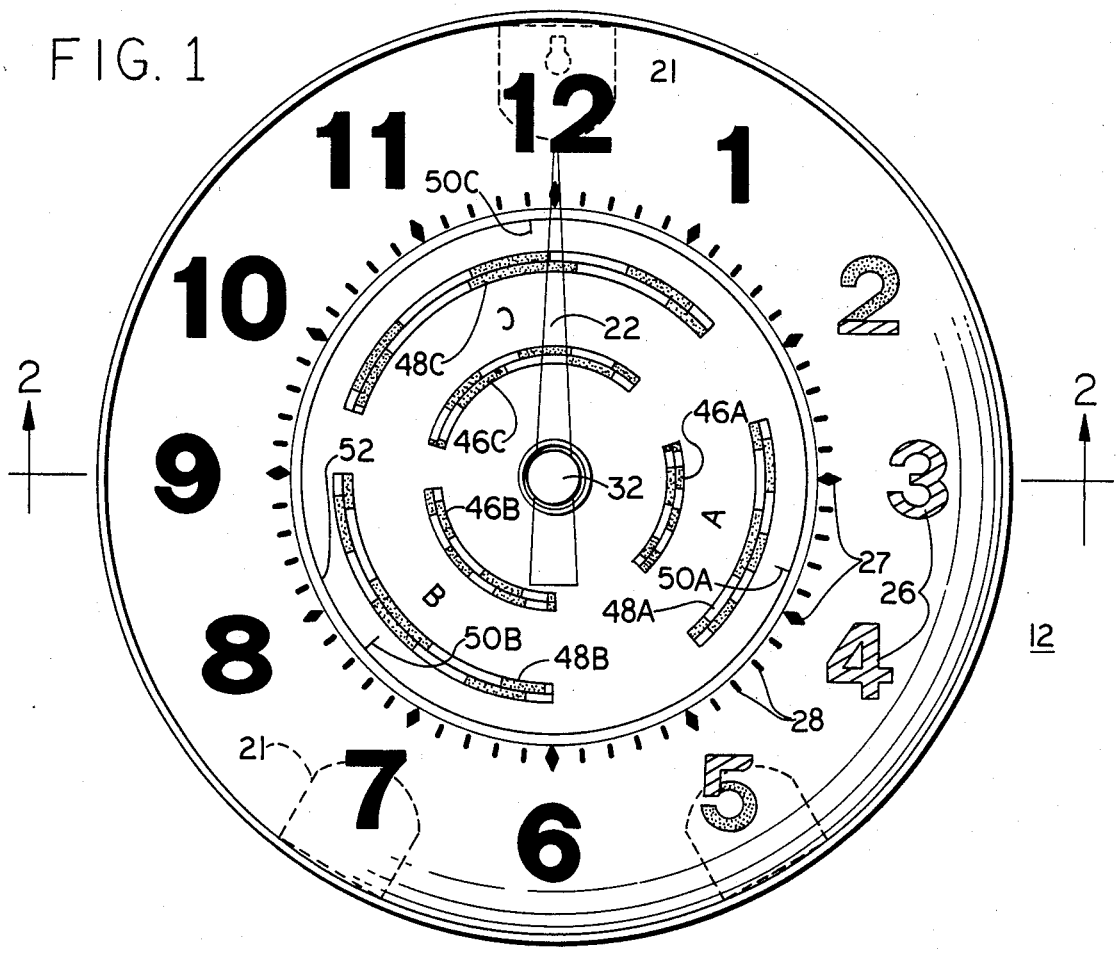
FIG. 1 is a view in front elevation of a clock which includes a device constructed in accordance with an embodiment of this invention for indicating times of sunrise and sunset.
Figure 2:
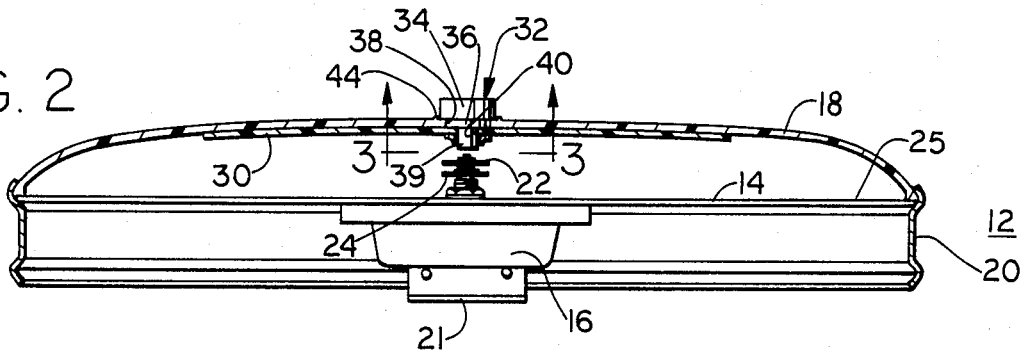
FIG. 2 is a view in section taken on a line 2—2 in FIG. 1.
Figure 3:
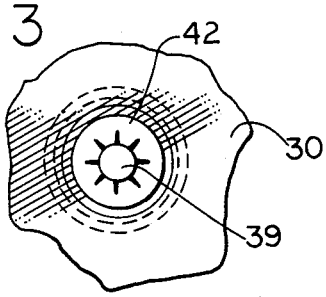
FIG. 3 is a view in section taken on the line 3—3 in FIG. 2.

In FIGS. 1 and 2 is shown a clock device 12 which includes a circular base plate 14 on which is mounted a clock drive 16 (not shown in detail). A transparent cover member 18 is mounted on the base plate 14 by means of a ring member 20. Hangers 21 mounted on the ring member 20 can be used for hanging the clock device. A minute hand 22 and an hour hand 24 are driven by the clock drive 16. On the exposed face 25 of the base plate 14 underlying the cover member 18 are numerical indicia 26 and diamond-shaped marks 27 indicating hours of the clock. On the exposed face 25 are also radial line marks 28 designating minutes for the minute hand 22 of the clock. As shown on FIG. 4, minute intervals are indicated for the hour hand 24 at 12 minute intervals as indicated by a line of numerals 29 and as will be explained in greater detail hereinafter.

A circular auxiliary disc 30 is rotatably mounted on the cover member 18 at the center of the clock face by means of a central fitting 32. The central fitting 32 includes an outer finger grip section 34, a central portion 36, which extends through an opening 38 in the cover member 18, and an inner stem 39, which extends through an opening 40 in the auxiliary disc 30. A spring clamp ring member 42 mounted on the stem 39 holds the auxiliary disc 30 and the fitting 32 in assembled relation so that the auxiliary disc 30 can be turned by means of the finger grip section 34. An annular rib 44 is formed on the cover member 18 surrounding the central fitting 32.

On the auxiliary disc 30 are disposed arcuate data units of solar passage information including inner arcuate data units 46A, 46B and 46C and outer arcuate data units 48A, 48B and 48C. The inner and outer arcuate data units are arranged in pairs indicated by the letters A, B and C in FIG. 1. Tic marks 50A, 50B and 50C are indicated on an outer circle 52 on the auxiliary disc 30 in proximity to the letters A, B and C, respectively. The pair of arcuate data units indicated by the letter B are illustrated in detail in FIG. 4, the other arcuate data units being of similar construction.

The outer arcuate data unit 48B includes a plurality of minor arcs 54, which are numbered to correspond to the months of the year. The minor arcs 54 are arranged to direct a radial line 56 to a position indicating a time for sunset on the line of numerals 29.

The inner arcuate data unit 46B includes minor arcs 58 which are numbered to correspond to months of the year. The arcs 58 are arranged to direct a radial line 60 to a time for sunrise on the line of numerals 29.

Figure 5:
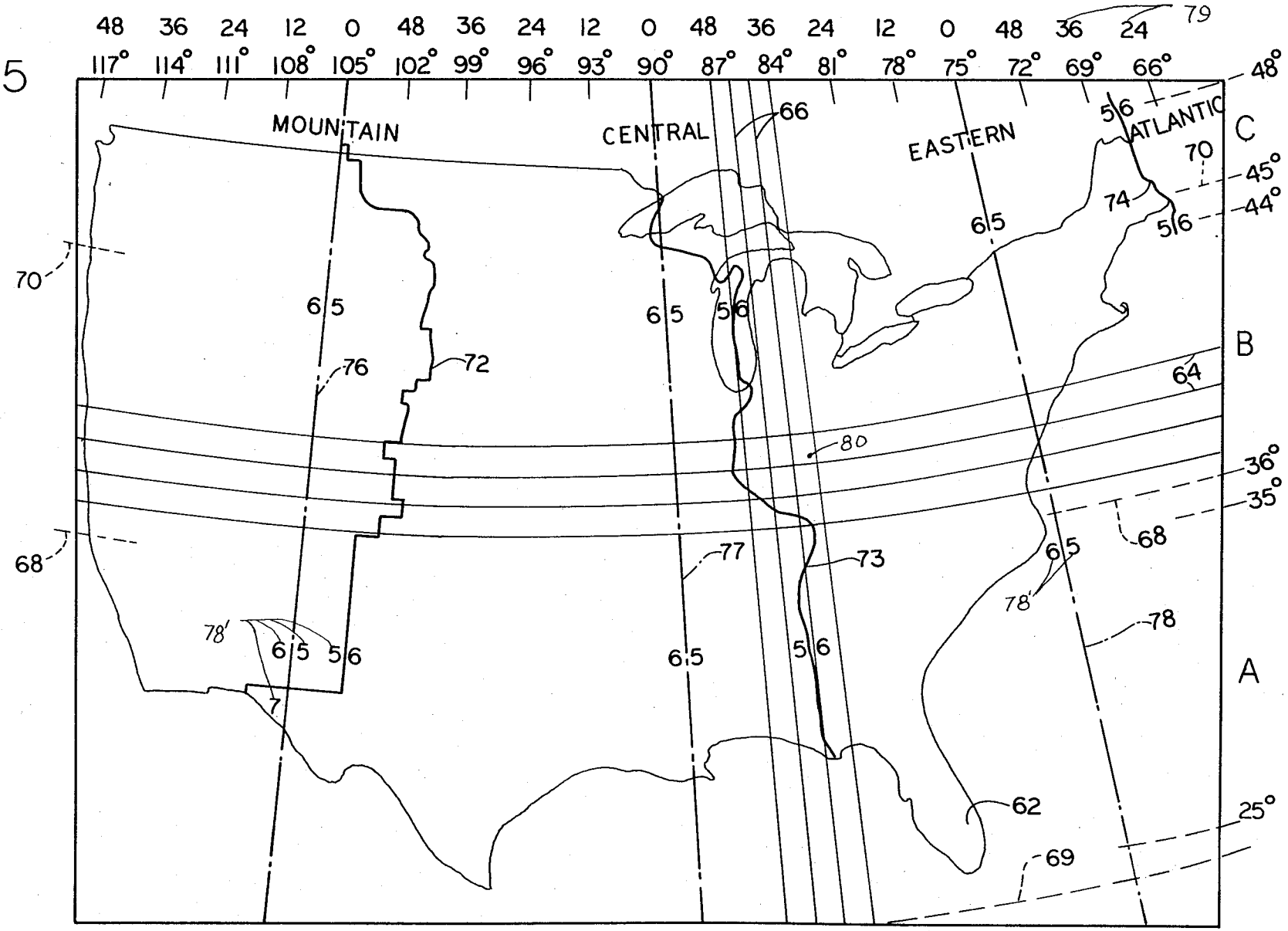
FIG. 5 is a fragmentary view of a map for use in connection with the device.

In FIG. 5 is shown a map 62 of a portion of the United States which is provided with lines 64 and 66 to indicate latitute and longitude, respectively. The map is divided into a southern section below a line 68 and above a line 69 and indicated A, a central section between the line 68 and a line 70 and indicated B, and a northern section above the line 70 and indicated C. These sections correspond with the pairs of arcuate data units of like letters in FIG. 1.

The map is divided into time zones as indicated by heavy lines 72, 73 and 74. Prime meridians of the time zones are indicated by dot-dash lines 76, 77 and 78. Numerals 78' are located in the time zone sections.

Associated with longitude markings at the upper edge of the map is a line of numerals 79 which advance by 12 minute intervals for each three degrees of longitude across each half time zone beginning at each prime meridian.

When the device is to be operated, a point on the map is selected, such as the point 80, which can be the location of Cincinnati, Ohio. Cincinnati is at approximately 39 degrees north latitude and 84 degrees west longitude. This point is in the B section of the map. It is in the western half of the eastern time zone, indicated by numerals 78', which are 6. The tic mark 50B associated with the B pair of arcuate data units is advanced to a position opposed to the hour numeral 6 on the clock.

An adjustment for longitude is next made. It will be noted that the longitude of Cincinnati is close to 84 degrees west longitude. Associated with 84 degrees west longitude on the map is a time of 36 minutes. The tic mark 50B is advanced to just beyond 36 minutes on the line of numerals 29 of the clock face associated with the hour numeral 6 (FIG. 4) and the device is ready for use in determining the standard time of sunrise and sunset at Cincinnati. If daylight time is desired, the disc is rotated one additional hour.

Figure 4:
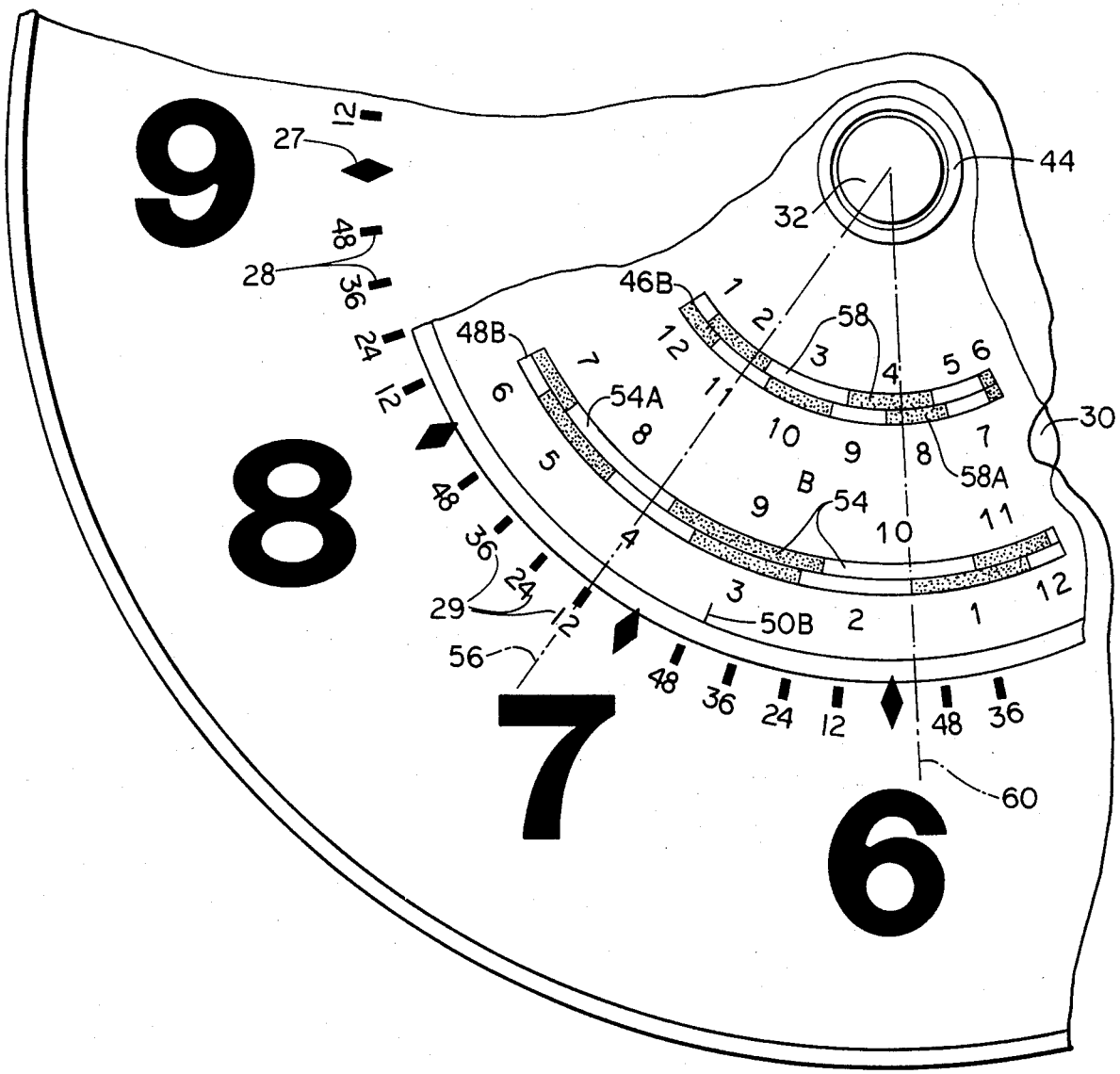
FIG. 4 is an enlarged fragmentary view of the clock in front elevation.

In FIG. 4, the device is set up to determine the times of sunrise and sunset for Aug. 28. The radial line 60 is drawn from the center of the clock face through the minor arc 58A at the point indicating Aug. 29 to the line of numerals 29 to indicate a time of sunrise of 5:55. The radial line 56 is drawn from the center of the clock face through the minor arc 54A at the point indicating Aug. 28 to the line of numbers 29 to indicate a time of sunset of 7:12.

As shown in FIG. 1, the hour numbers 2, 3, 4 and 5 of the numerical indicia 26 are shaded to set them off from the other numbers of the indicia 26 to indicate the usual average time of the warmest part of the day.

The device also serves to indicate the average time of the coolest part of the day as that time is close to the time of sunrise.

The device for determining sunrise and sunset described above and illustrated in the drawings is subject to structural modification without departing from the spirit and scope of the appended claims.

Having described my invention, what I claim as new and desire to secure by letters patent is:

1. A device for determining the time of solar passage of the horizon which comprises a clock face having hour and minute indications arranged circumferentially thereof, a disc rotatably mounted in overlying relation with the clock face and at a center thereof, solar passage information on the disc, and an alignment indicator on the disc in association with the solar passage information and alignable with a selected position on the hour and minute indications corresponding to a selected longitude so that a line from the center of the disc through a selected portion of the solar passage information intercepts the hour and minute indications at a time of solar passage for the selected portion of the solar passage information at the selected longitude.

2. A device as in claim 1 in which the solar passage information includes separate sunrise and sunset information units.

3. A device as in claim 1 in which the solar passage information includes a plurality of units for selected latitudes.

4. A device as in claim 1 in which the solar passage information is arranged by days in months of the year.

5. A device for determining the time of solar passage of the horizon in standard time which comprises a clock face having hour and minute indications arranged circumferentially thereof, a disc rotatably mounted in overlying relation with the clock face and at a center thereof, solar passage information on the disc, and an alignment indicator on the disc in association with the solar passage information and alignable with a selected position on the hour and minute indications corresponding to a selected longitude so that a line from the center of the disc through a selected portion of the solar passage information intercepts the hour and minute indications at a time of solar passage for the selected portion of the solar passage information at the selected longitude.

6. A device as in claim 5 in which the solar passage information is arranged by days in months of the year.

7. A device as in claim 5 in which the solar passage information includes separate sunrise and sunset information units.

8. A device as in claim 5 in which the solar passage information includes a plurality of units for selected latitudes.

* * * * *